US010745980B2

(12) United States Patent
Stewart et al.

(10) Patent No.: US 10,745,980 B2
(45) **Date of Patent: *Aug. 18, 2020**

(54) VERTICAL LIFT ROTARY TABLE

(71) Applicant: Ensco International Incorporated, Wilmington, DE (US)

(72) Inventors: Christopher Scott Stewart, Cornelius, NC (US); Richard Robert Roper, Katy, TX (US)

(73) Assignee: ENSCO INTERNATIONAL INCORPORATED, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/417,417

(22) Filed: May 20, 2019

(65) Prior Publication Data

US 2019/0271198 A1 Sep. 5, 2019

Related U.S. Application Data

(63) Continuation of application No. 15/934,673, filed on Mar. 23, 2018, now Pat. No. 10,294,737.

(Continued)

(51) Int. Cl.
*E21B 19/09* (2006.01)
*E21B 19/10* (2006.01)

(Continued)

(52) U.S. Cl.
CPC ..... *E21B 19/09* (2013.01); *E21B 3/045* (2013.01); *E21B 19/08* (2013.01); *E21B 19/10* (2013.01);

(Continued)

(58) Field of Classification Search
CPC ..... E21B 19/09; E21B 19/10; E21B 19/143; E21B 19/168; E21B 19/22
See application file for complete search history.

(56) References Cited

U.S. PATENT DOCUMENTS 3,404,741 A 10/1968 Gheorghe et al.
3,961,399 A 6/1976 Boyadjeff (Continued)

FOREIGN PATENT DOCUMENTS

CN 202017480 10/2011
KR 101334353 5/2013

(Continued)

OTHER PUBLICATIONS

Grinrod, Mads. "Continuous Motion Rig: A Step Change in Drilling Equipment," IADC/SEP 128253, Well System Technology A/S, 2010, 5 pps.

(Continued)

*Primary Examiner* — Matthew R Buck
(74) *Attorney, Agent, or Firm* — Fletcher Yoder, P.C.

(57) ABSTRACT

A system, including one or more supports disposed on a drill floor. The system also includes a movable support slidingly coupled to the one or more supports and configured to be selectively moved towards the drill floor during a tripping-in operation as part of a continuous tripping operation and away from the drill floor during a tripping-in operation as part of a continuous tripping operation, and a tripping apparatus coupled to the movable support and configured to make up or break out a threaded joint between a first tubular segment and a second tubular segment, wherein the tripping apparatus is configured to be selectively movable from a first position disposed proximate to the one or more supports and a second position at a distance away from the one or more supports to make up the threaded joint when the tripping apparatus is disposed in the second position during the tripping-in operation or to break out the threaded joint when the tripping apparatus is disposed in the second position during the tripping-out operation.

11 Claims, 12 Drawing Sheets

Related U.S. Application Data

(60) Provisional application No. 62/475,848, filed on Mar. 23, 2017.

(51) Int. Cl.

| | |
|---|---|
| ***E21B 19/16*** | (2006.01) |
| ***E21B 19/22*** | (2006.01) |
| ***E21B 19/14*** | (2006.01) |
| ***E21B 3/04*** | (2006.01) |
| ***E21B 44/02*** | (2006.01) |
| ***E21B 19/08*** | (2006.01) |
| *E21B 19/083* | (2006.01) |

(52) U.S. Cl.
CPC ..... *E21B 19/143* (2013.01); *E21B 19/168* (2013.01); *E21B 19/22* (2013.01); *E21B 44/02* (2013.01); *E21B 19/083* (2013.01)

(56) References Cited

U.S. PATENT DOCUMENTS

| | | | | |
|---|---|---|---|---|
| 3,978,993 | A | 9/1976 | Howard | |
| 4,042,123 | A | 8/1977 | Sheldon et al. | |
| 4,531,875 | A | 7/1985 | Krueger | |
| 4,696,207 | A | 9/1987 | Boyadjieff | |
| 4,765,401 | A | 8/1988 | Boyadjieff | |
| 4,822,230 | A | 4/1989 | Sieltedal | |
| 4,951,759 | A | 8/1990 | Richardson | |
| 5,191,939 | A | 3/1993 | Stokley | |
| 5,244,329 | A | 9/1993 | McGill et al. | |
| 5,423,390 | A | 6/1995 | Donnally et al. | |
| 5,682,952 | A | 11/1997 | Stokley | |
| 6,000,480 | A * | 12/1999 | Eik | E21B 19/008 166/350 |
| 6,349,764 | B1 | 2/2002 | Adams et al. | |
| 6,688,394 | B1 | 2/2004 | Ayling | |
| 6,821,071 | B2 | 11/2004 | Woolslayer et al. | |
| 6,994,505 | B2 | 2/2006 | Hawkins, III | |
| 7,331,746 | B2 | 2/2008 | Wright et al. | |
| 7,540,338 | B2 | 6/2009 | Belik | |
| 7,878,254 | B2 | 2/2011 | Abdollahi et al. | |
| 8,210,279 | B2 | 7/2012 | Tarique | |
| 8,794,351 | B2 * | 8/2014 | Krohn | E21B 3/02 175/57 |
| 9,874,060 | B2 * | 1/2018 | Roodenburg | B63B 35/4413 |
| 10,294,737 | B2 * | 5/2019 | Stewart | E21B 19/09 |
| 2003/0221519 | A1 * | 12/2003 | Haugen | E21B 3/04 81/57.15 |
| 2003/0221871 | A1 * | 12/2003 | Hamilton | E21B 19/14 175/85 |
| 2004/0240973 | A1 | 12/2004 | Andrews et al. | |
| 2005/0056122 | A1 | 3/2005 | Belik | |
| 2005/0155757 | A1 | 7/2005 | Paton | |
| 2005/0238463 | A1 | 10/2005 | Smith | |
| 2006/0137910 | A1 | 6/2006 | Hamner | |
| 2007/0074606 | A1 | 4/2007 | Halse | |
| 2008/0223418 | A1 | 9/2008 | Vante | |
| 2009/0294174 | A1 | 12/2009 | Harmer et al. | |
| 2010/0243325 | A1 | 9/2010 | Veeningen | |
| 2012/0318530 | A1 * | 12/2012 | Wollum | E21B 15/00 166/379 |
| 2013/0025937 | A1 * | 1/2013 | Pilgrim | E21B 21/01 175/24 |
| 2013/0341036 | A1 | 12/2013 | Flusche | |
| 2014/0124218 | A1 * | 5/2014 | Pilgrim | E21B 44/02 166/380 |
| 2016/0017674 | A1 | 1/2016 | Richardson et al. | |
| 2016/0123094 | A1 * | 5/2016 | Amezaga | E21B 19/165 166/380 |
| 2016/0153245 | A1 * | 6/2016 | Roodenburg | B63B 35/4413 166/352 |
| 2017/0074056 | A1 | 3/2017 | Roodenburg et al. | |

FOREIGN PATENT DOCUMENTS

| | | |
|---|---|---|
| WO | 1984001599 | 4/1984 |
| WO | 2016197255 | 12/2016 |
| WO | 2017127924 | 8/2017 |
| WO | 2017193217 | 11/2017 |

OTHER PUBLICATIONS

Grinrod, et al. "Continuous Motions Rig. A Detailed Study of a 750 Ton Capacity, 3600 m/hr Trip Speed Rig," SPE/IADC 139403, Weist Drilling Products AS, 2011, 10 pps.

"Automated Rig Equipment," http://www.weatherford.com/weatherford/groups/web/documents/weatherfordcorp/wft103221.pdf, 2012, 86 pps.

Brugman, "Automated Pipe Handing: A Fresh Approach," http://www.weatherford.com/weatherford/groups/web/documents/weatherfordcorp/wft103221.pdf, 2012, 2 pps.

Skjaerseth, "Continuous Motion Rig (CMR Technology)—A Step Change in Drilling Efficiency," OTC-25459-MS, WeST Drilling Product AS, 2014, 7 pps.

Chmela et al., "Safer Tripping Through Drilling Automation," https://www.onepetro.org/conference-paper/SPE-168018-MS, Apr. 24, 2014, 2 pps.

International Application No. PCT/US2013/066145, International Search Report and Written Opinion dated Aug. 18, 2014, 10 pps.

Australian Application No. 2013334830, Examination Report dated Oct. 19, 2017, 1 pp.

Canadian Application No. 2883713, Examination Report dated Dec. 27, 2017, 1 pp.

PCT Application No. PCT/US2018/024125 International Search Resport and Written Opinion, dated Jul. 26, 2018, 17 pgs.

* cited by examiner

VERTICAL LIFT ROTARY TABLE

CROSS REFERENCE TO RELATED APPLICATIONS

This application is a continuation of U.S. application Ser. No. 15/934,673, entitled "Vertical Lift Rotary Table," and filed Mar. 23, 2018, now U.S. Pat. No. 10,294,737 which issued on May 21, 2019, which is a Non-Provisional Application claiming priority to U.S. Provisional Patent Application No. 62/475,848 entitled "Vertical Lift Rotary Table", filed Mar. 23, 2017, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. Likewise, drilling advances have allowed for increased access to land based reservoirs.

Much of the time spent in drilling to reach these reservoirs is wasted "non-productive time" (NPT) that is spent in doing activities which do not increase well depth, yet may account for a significant portion of costs. For example, when drill pipe is pulled out of or lowered into a previously drilled section of well it is generally referred to as "tripping." Accordingly, tripping-in may include lowering drill pipe into a well (e.g., running in the hole or RIH) while tripping-out may include pulling a drill pipe out of the well (pulling out of the hole or POOH). Tripping operations may be performed to, for example, installing new casing, changing a drill bit as it wears out, cleaning and/or treating the drill pipe and/or the wellbore to allow more efficient drilling, running in various tools that perform specific jobs required at certain times in the oil well construction plan, etc. Additionally, tripping operations may require a large number of threaded pipe joints to be disconnected (broken-out) or connected (made-up). This process may involve halting of the pipe joints at a fixed position to allow for the tripping operation to be undertaken, which can greatly extend the time required to complete a tripping operation.

DETAILED DESCRIPTION

Figure 1:
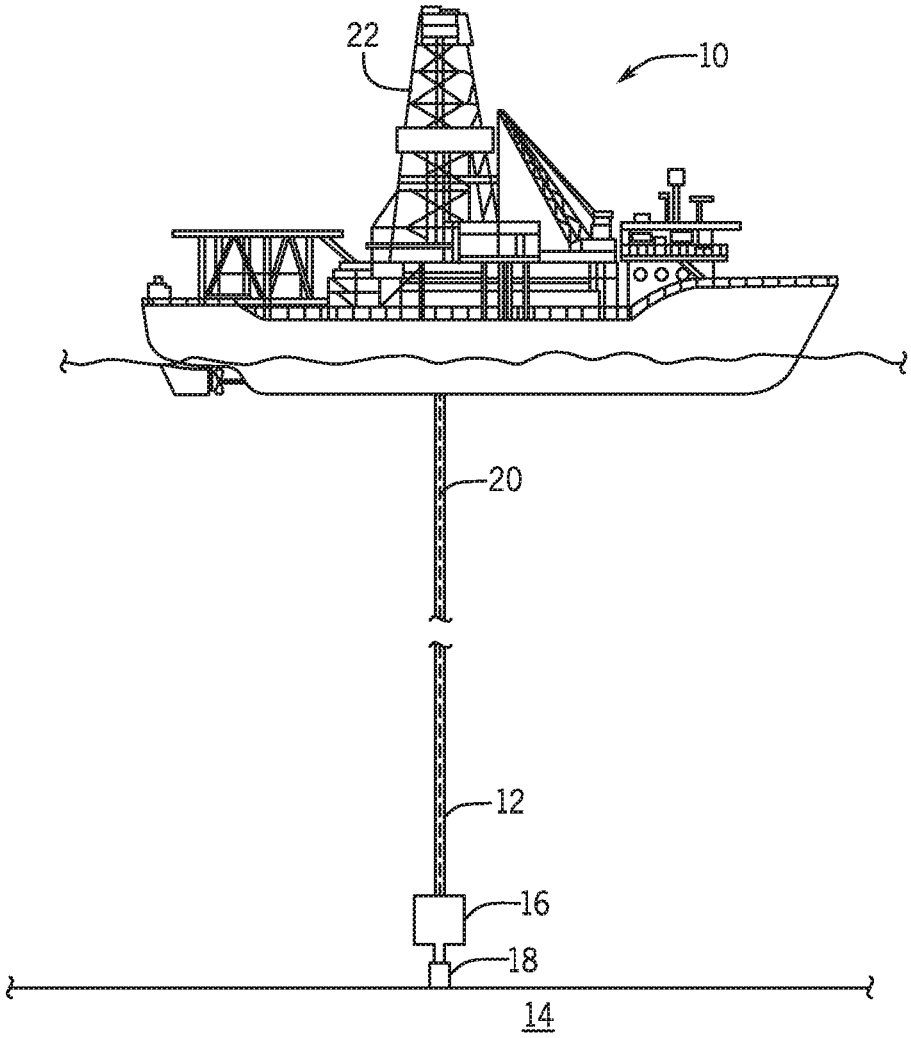
FIG. 1 illustrates an example of an offshore platform having a riser coupled to a blowout preventer (BOP), in accordance with an embodiment.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Oil and gas drilling operations on land and offshore require frequent movement of the drill string in and out of the well bore to facilitate the drilling process. This process becomes very time consuming when drilling deep wells. The drilling string is comprised of drill pipe segments that are connected together with a coupling. The coupling may be, for example a threaded connection with a pin and box end. The drill pipe segments are connected together mechanically by a roughneck machine (e.g., an iron roughneck or more simply a roughneck). Thus, present embodiments are directed to components, systems, and techniques utilized in an automated tripping apparatus.

The automated tripping apparatus may include a movable support slidingly coupled to a frame and positioned to be selectively moved towards and away from a tubular segment support system. In some embodiments, the movable support may include a rotary table on a drilling rig that provides rotational force (e.g., in a clockwise direction) to a drill string to facilitate the process of drilling a borehole. The rotary table may be used in conjunction with or as a back-up to a top drive. The movable support may also be of a sufficient size to support a roughneck. The roughneck may be disposed upon the movable support, for example, between the movable support and the tubular segment support system. The roughneck may be positioned to make up or break out a threaded joint between a first and a second tubular segment of a tubular string as part of a tripping operation. This process may be repeatable and may be undertaken as the movable support is in transition toward or away from the tubular segment support system.

As the drill string is made longer by connected drill pipe, it can be supported by, for example, drilling slips, elevators, or similar systems as the tubular segment support system. The drilling slips may also be contained in the movable support (e.g., as part of the rotary table therein). A rotary table is typically mounted to the drill floor substructure for support of the drill string loads; however, as previously noted, in present embodiments, the rotary table itself is movable in conjunction with the movable support and, thus, is not mounted to the drill floor during a tripping operation.

In some embodiments, the automated tripping apparatus may operate to make up and break out tubular segments of a tubular string being tripped in or out of a wellbore (or towards or away from a wellbore) while the tubular string is in continuous motion. Because the tubular string is in constant motion, the tubular string may be able to be tripped in the same amount as time as a traditional discontinuous tripping procedure while the tubular string remains at a slower speed than would be reached by a tubular string in a discontinuous tripping operation. This may reduce "surging" while tripping-in, or "swabbing" while tripping-out, e.g., pressure fluctuations that may cause, for example, reservoir fluids to flow into the wellbore or cause instability in a formation surrounding a wellbore as well as, for example, hydraulic shocks that may result from starting and stopping of a tubular string in the wellbore. In other embodiments, tripping may be performed at, for example, the same speed as performed in conjunction with a discontinuous tripping operation but because the tubular string is in constant motion, and does not include stopping times to make up or break out segments of the tubular string, the time to complete a tripping operation may be reduced relative to a discontinuous tripping operation with no increase to the speed at which the tripping operation is undertaken.

Accordingly, present embodiments consist of a movable platform (e.g., vertically or at an incline, in the situation of directional or slant drilling) in which the rotary table may be mounted. This movable platform may interface with the existing rig structure such as the top drive dolly tracks, rig derrick, or similar. The movable platform may allow the attachment of various other machines or appendages such as a stabbing arm, roughneck, lift cylinders, cables, sensors, or similar components.

The movable platform may be recessed into the drill floor structure to allow it to be used in a conventional drilling application, or alternatively, be placed on top of the drill floor. In some embodiments, the movable platform may have guide pins or similar to provide coarse and fine alignment when moving in and out of the drill floor. The movable platform may be raised and lowered with a cable and sheave arrangement, direct acting cylinders, suspended winch mechanism, or similar internal or external actuation system. In some embodiments, the movable platform may use a lateral supports such as, for example, pads that may be made of Teflon-graphite material or another low-friction material (e.g., a composite material) that allows for motion of the movable platform relative to drill floor and/or the tubular segment support system with reduced friction characteristics. In addition to, or in place of the aforementioned pads, other lateral supports including bearing or roller type supports (e.g., steel or other metallic or composite rollers and/or bearings) may be utilized. The lateral supports may allow the movable platform to interface with a support element (e.g., guide tracks, such as top drive dolly tracks) so that the movable platform is movably coupled to the support element. Accordingly, the movable platform may be movably coupled a support element to allow for movement of the movable platform (e.g., towards and away from the drill floor and/or the tubular segment support system while maintaining contact with the guide tracks or other connection element.

With the foregoing in mind, FIG. 1 illustrates an offshore platform 10 as a drillship. Although the presently illustrated embodiment of an offshore platform 10 is a drillship (e.g., a ship equipped with a drilling system and engaged in offshore oil and gas exploration and/or well maintenance or completion work including, but not limited to, casing and tubing installation, subsea tree installations, and well capping), other offshore platforms 10 such as a semi-submersible platform, a spar platform, a floating production system, or the like may be substituted for the drillship. Indeed, while the techniques and systems described below are described in conjunction with a drillship, the techniques and systems are intended to cover at least the additional offshore platforms 10 described above. Likewise, while an offshore platform 10 is illustrated and described in FIG. 1, the techniques and systems described herein may also be applied to and utilized in onshore drilling activities. These techniques may also apply to at least vertical drilling or production operations (e.g., having a rig in a primarily vertical orientation drill or produce from a substantially vertical well) and/or directional drilling or production operations (e.g., having a rig in a primarily vertical orientation drill or produce from a substantially non-vertical or slanted well or having the rig oriented at an angle from a vertical alignment to respective to drill or produce from a substantially non-vertical or slanted well).

As illustrated in FIG. 1, the offshore platform 10 includes a riser string 12 extending therefrom. The riser string 12 may include a pipe or a series of pipes that connect the offshore platform 10 to the seafloor 14 via, for example, a BOP 16 that is coupled to a wellhead 18 on the seafloor 14. In some embodiments, the riser string 12 may transport produced hydrocarbons and/or production materials between the offshore platform 10 and the wellhead 18, while the BOP 16 may include at least one BOP stack having at least one valve with a sealing element to control wellbore fluid flows. In some embodiments, the riser string 12 may pass through an opening (e.g., a moonpool) in the offshore platform 10 and may be coupled to drilling equipment of the offshore platform 10. As illustrated in FIG. 1, it may be desirable to have the riser string 12 positioned in a vertical orientation between the wellhead 18 and the offshore platform 10 to allow a drill string made up of drill pipes 20 to pass from the offshore platform 10 through the BOP 16 and the wellhead 18 and into a wellbore below the wellhead 18. Also illustrated in FIG. 1 is a drilling rig 22 (e.g., a drilling package or the like) that may be utilized in the drilling and/or servicing of a wellbore below the wellhead 18.

Figure 2:
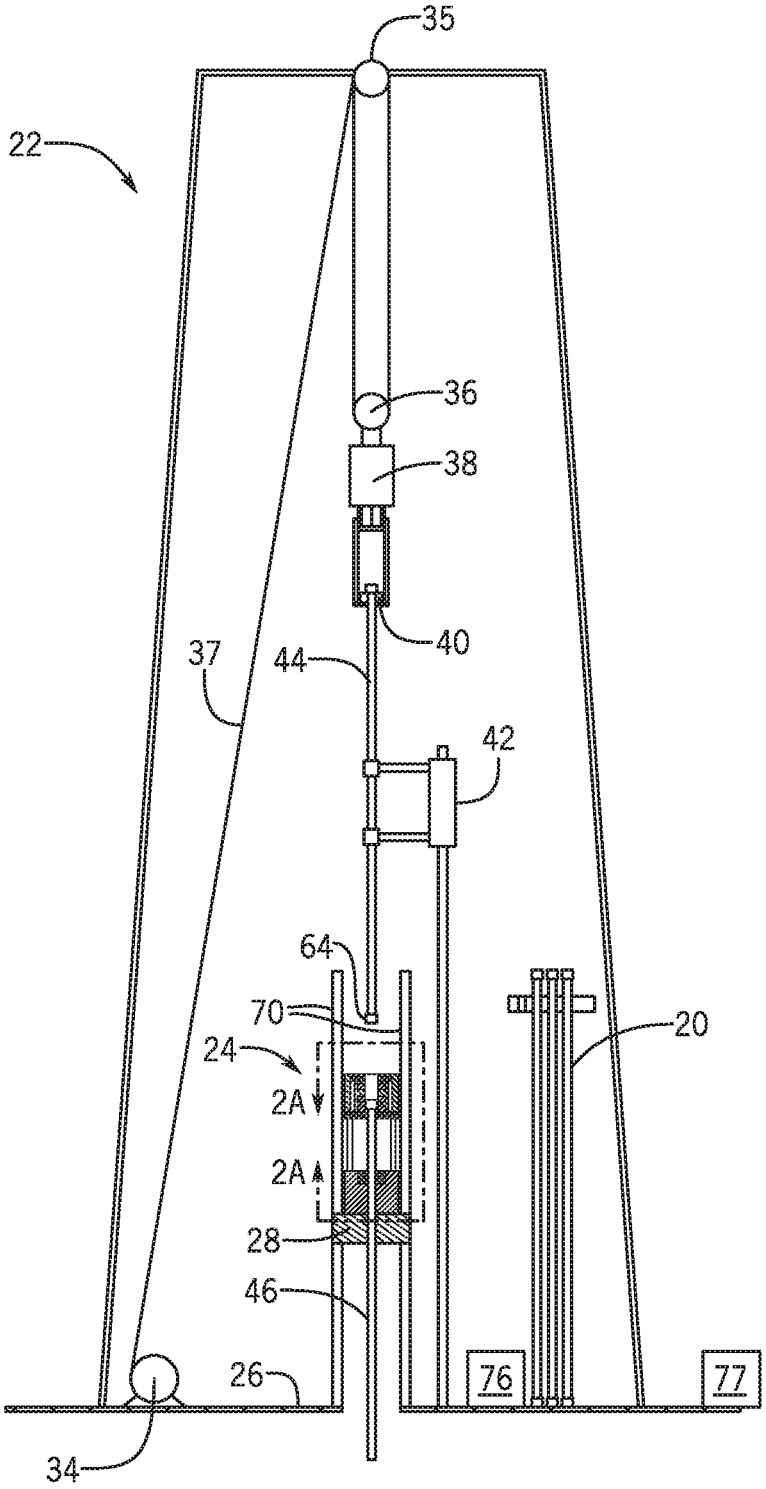
FIG. 2 illustrates a front view a drill rig as illustratively presented in FIG. 1, in accordance with an embodiment.
Figure 3:
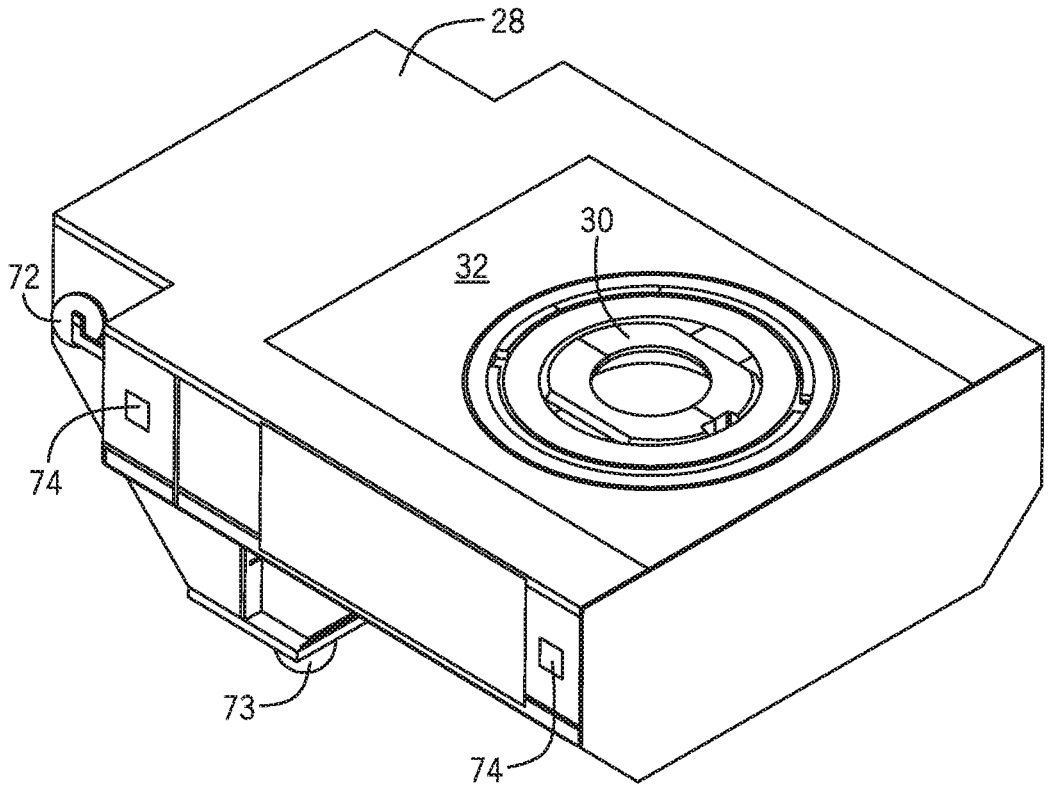
FIG. 3 illustrates an isometric view of a movable platform of FIG. 2, in accordance with an embodiment.

In a tripping operation consistent with embodiments of the present disclosure, as depicted in FIG. 2, a tripping apparatus 24 is illustrated as being positioned above drill floor 26 in the drilling rig 22 above the wellbore (e.g., the drilled hole or borehole of a well which may be proximate to the drill floor 26 or which may be, in conjunction with FIG. 1, below the wellhead 18). However, as will be discussed in greater detail below, the tripping apparatus may be moved towards and away from the drill floor 26 during a tripping operation. As illustrated, the drilling rig 22 may include one or more of, for example, the tripping apparatus 24, a movable platform 28 (that may include floor slips 30 positioned in rotary table 32, as illustrated in FIG. 3), drawworks 34, a crown block 35, a travelling block 36, a top drive 38, an elevator 40, and a tubular handling apparatus 42. The tripping apparatus 24 may operate to couple and decouple tubular segments (e.g., couple and decouple drill pipe 20 to and from a drill string) while the floor slips 30 may operate to close upon and hold a drill pipe 20 and/or the drill string passing into the wellbore. The rotary table 32 may be a rotatable portion that can locked into position co-planar with the drill floor 26 and/or above the drill floor 26. The rotary table 32 can, for example, operate to impart rotation to the drill string either as a primary or a backup rotation system (e.g., a backup to the top drive 38) as well as utilize its floor slips 30 to support tubular segments, for example, during a tripping operation.

The drawworks 34 may be a large spool that is powered to retract and extend drilling line 37 (e.g., wire cable) over a crown block 35 (e.g., a vertically stationary set of one or more pulleys or sheaves through which the drilling line 37 is threaded) and a travelling block (e.g., a vertically movable set of one or more pulleys or sheaves through which the drilling line 37 is threaded) to operate as a block and tackle system for movement of the top drive 38, the elevator 40, and any tubular segment (e.g., drill pipe 20) coupled thereto. In some embodiments, the top drive 38 and/or the elevator 40 may be referred to as a tubular support system or the tubular support system may also include the block and tackle system described above.

The top drive 38 may be a device that provides torque to (e.g., rotates) the drill string as an alternative to the rotary table 32 and the elevator 40 may be a mechanism that may be closed around a drill pipe 20 or other tubular segments (or similar components) to grip and hold the drill pipe 20 or other tubular segments while those segments are moving vertically (e.g., while being lowered into or raised from a wellbore) or directionally (e.g., during slant drilling). The tubular handling apparatus 42 may operate to retrieve a tubular segment from a storage location (e.g., a pipe stand) and position the tubular segment during tripping-in to assist in adding a tubular segment to a tubular string. Likewise, the tubular handling apparatus 42 may operate to retrieve a tubular segment from a tubular string and transfer the tubular segment to a storage location (e.g., a pipe stand) during tripping-out to remove the tubular segment from the tubular string.

Figure 2A:
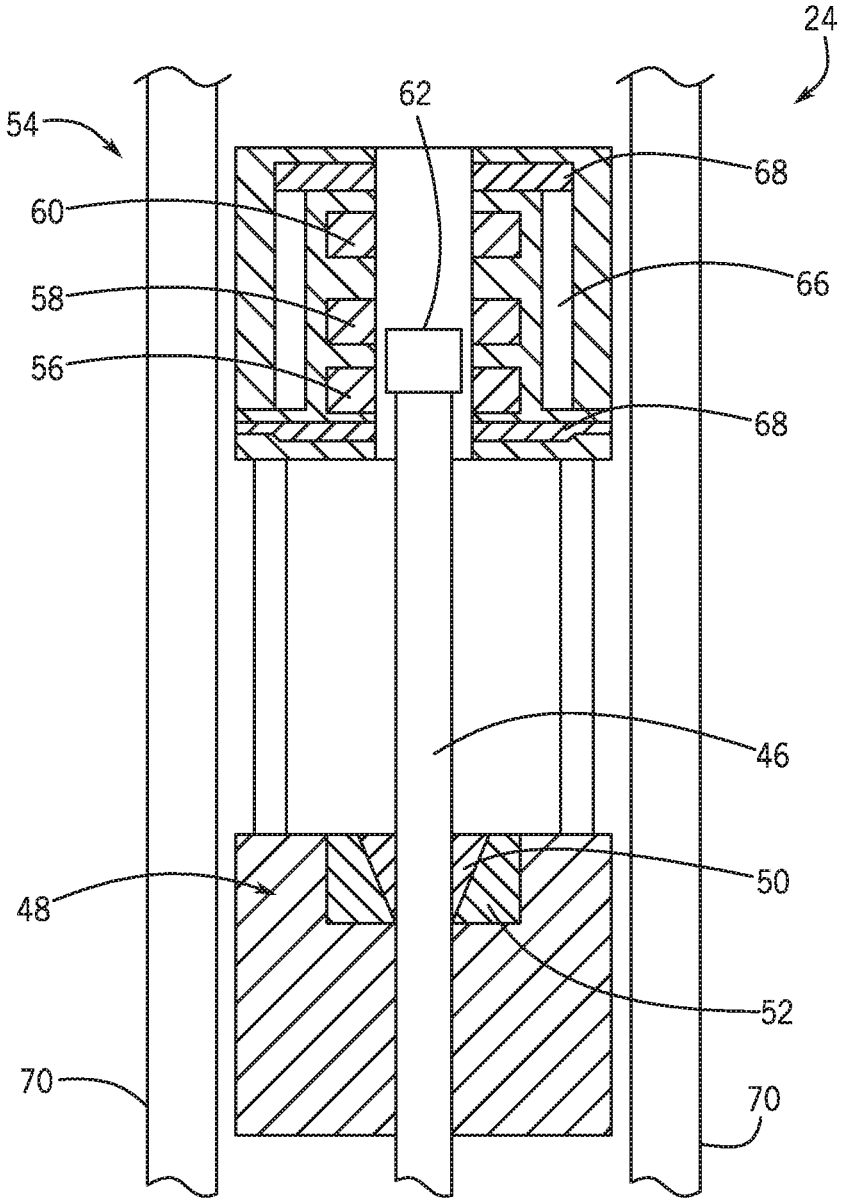
FIG. 2A illustrates a front view of the tripping apparatus of FIG. 2, in accordance with an embodiment.

During a tripping-in operation, the tubular handling apparatus 42 may position a tubular segment 44 (e.g., a drill pipe 20) so that the tubular segment 44 may be grasped by the elevator 40. Elevator 40 may be lowered, for example, via the block and tackle system towards the tripping apparatus 24 to be coupled to tubular segment 46 (e.g., a drill pipe 20) as part of a drill string. As illustrated in FIG. 2A, the tripping apparatus 24 may include tripping slips 48 inclusive of slip jaws 50 that engage and hold the segment 46 as well as a forcing ring 52 that operates to provide force to actuate the slip jaws 50. The tripping slips 48 may, thus, be activated to grasp and support the segment, and, accordingly, an associated tubular string (e.g., drill string) when the tubular string is disconnected from block and tackle system. The tripping slips 48 may be actuated hydraulically, electrically, pneumatically, or via any similar technique. In some embodiments, the tripping slips 48 may be omitted and the floor slips 30 may be used in place of the tripping slips 48. Likewise, the tripping slips 48 may, in some embodiments, be used in combination with the floor slips 30.

The tripping apparatus 24 may further include a roughneck 54 that may operate to selectively make-up and break-out a threaded connection between tubular segments 44 and 46 in a tubular string. In some embodiments, the roughneck 54 may include one or more of fixed jaws 56, makeup/breakout jaws 58, and a spinner 60. In some embodiments, the fixed jaws 56 may be positioned to engage and hold the (lower) tubular segment 46 below a threaded joint 62 thereof. In this manner, when the (upper) tubular segment 44 is positioned coaxially with the tubular segment 46 in the tripping apparatus 24, the tubular segment 46 may be held in a stationary position to allow for the connection of the tubular segment 44 and the tubular segment 46 (e.g., through connection of the threaded joint 62 of the tubular segment 46 and a threaded joint 64 of the tubular segment 44).

To facilitate this connection, the spinner 60 and the makeup/breakout jaws 58 may provide rotational torque. For example, in making up the connection, the spinner 60 may engage the tubular segment 44 and provide a relatively high-speed, low-torque rotation to the tubular segment 44 to connect the tubular segment 44 to the tubular segment 46. Likewise, the makeup/breakout jaws 58 may engage the tubular segment 44 and may provide a relatively low-speed, high-torque rotation to the tubular segment 44 to provide, for example, a rigid connection between the tubular segments 44 and 46. Furthermore, in breaking-out the connection, the makeup/breakout jaws 58 may engage the tubular segment 44 and impart a relatively low-speed, high-torque rotation on the tubular segment 44 to break the rigid connection. Thereafter, the spinner 60 may provide a relatively high-speed, low-torque rotation to the tubular segment 44 to disconnect the tubular segment 44 from the tubular segment 46.

In some embodiments, the roughneck 54 may further include a mud bucket 66 that may operate to capture drilling fluid, which might otherwise be released during, for example, the break-out operation. In this manner, the mud bucket 66 may operate to prevent drilling fluid from spilling onto drill floor 26. In some embodiments, the mud bucket 66 may include one or more seals 68 that aid in fluidly sealing the mud bucket 66 as well as a drain line that operates to allow drilling fluid contained within mud bucket 66 to return to a drilling fluid reservoir.

The roughneck 54 may be movable towards and away from the drill floor 26 and, in some embodiments, relative to the tripping slips 48. Movement of the roughneck 54 may be accomplished through the use of hydraulic pistons, jack-screws, racks and pinions, cable and pulley, a linear actuator, or the like. This movement may be beneficial to aid in proper location of the roughneck 54 during a make-up or break-out operation (e.g., during a tripping-in or tripping-out operation).

Returning to FIG. 2, the movable platform 28, may be raised and lowered with a cable and sheave arrangement (e.g., similar to the block and tackle system for movement of the top drive 38) that may include a winch or other drawworks element positioned on the drill floor 26 or elsewhere on the offshore platform 10 or the drilling rig 22. The winch or other drawworks element may be a spool that is powered to retract and extend line (e.g., a wire cable or drilling line 37) over a crown block (e.g., a stationary set of one or more pulleys or sheaves through which the drilling line 37 is threaded) and a travelling block (e.g., a movable set of one or more pulleys or sheaves through which the drilling line 37 is threaded) to operate as a block and tackle system for movement of the movable platform 28 and, thus the rotary table 32 therein and the tripping apparatus 24 thereon. Additionally and/or alternatively, direct acting cylinders, a suspended winch and cable system mechanism disposed such that the movable platform 28 is between the and the suspended winch and cable system and the drill floor 26, or similar internal or external actuation systems may be used to move the movable platform along support element 70.

In some embodiments, the support element 70 may be one or more guide mechanisms (e.g., guide tracks, such as top drive dolly tracks) so that provide support (e.g., lateral support) to the movable platform 28 while allowing for movement towards and away from the drill floor 26. Additionally, as illustrated in FIG. 3, one or more lateral supports 72 may be used to couple the movable platform to the support element 70. For example, the lateral supports 72 may be, for example, pads that may be made of Teflon-graphite material or another low-friction material (e.g., a composite material) that allows for motion of the movable platform 28 relative to drill floor 26 and/or the tubular segment support system with reduced friction characteristics. In addition to, or in place of the aforementioned pads, other lateral supports 72 including bearing or roller type supports (e.g., steel or other metallic or composite rollers and/or bearings) may be utilized. The lateral supports 72 may allow the movable platform 28 to interface with a support element 70 (e.g., guide tracks, such as top drive dolly tracks) so that the movable platform 28 is movably coupled to the support element 70. Accordingly, the movable platform 28 may be movably coupled a support element 70 to allow for movement of the movable platform 28 (e.g., towards and away from the drill floor 26 and/or the tubular segment support system while maintaining contact with the guide tracks or other support element 70) during a tripping operation (e.g., a continuous tripping operation).

As further illustrated in FIG. 3, the movable platform 28 may have guide pins 73 or similar devices to provide coarse and fine alignment when moving in and out of the drill floor 26 (e.g., into a planar position with the drill floor 26 or raised above the drill floor 26). Additionally, one or more locking mechanisms may be employed to affix the movable platform 28 into a desired position with respect to the drill floor 26, for example, when a tripping operation is complete or not necessary. In this fixed position, the rotary table 32 may operate in conjunction with the top drive 38 and/or as a backup system to the top drive 38. The locking elements 74 may be automatic (e.g., controllable) such that they can be actuated without human contact (e.g., a control signal may cause pins or other locking mechanisms to engage an aperture between the drill floor 26 and the movable platform 28). It is envisioned that the locking elements 74 will interface with a raised platform on the drill floor 26 (if the movable platform 28 is to be locked in a position above the drill floor 26, e.g., planar to the raised platform thereon) or the locking elements may interface with the drill floor 26 or an element beneath the drill floor (if the movable platform 28 is to be locked in a position planar with the drill floor 26).

Returning to FIG. 2, a computing system 76 may be present and may operate in conjunction with one or more of the tripping apparatus 24, the movable platform 28, an actuating system used to move the tripping apparatus 24, and/or an actuating system used to move the movable platform 28. This computing system 76 may also operate to control one or more of the tubular segment support system and/or the tubular handling apparatus 42. It should be noted that the computing system 76 may be a standalone unit (e.g., a control monitor). However, in some embodiments, the computing system 76 may be communicatively coupled to a separate main control system 77, for example, a control system in a driller's cabin that may provide a centralized control system for drilling controls, automated pipe handling controls, and the like. In other embodiments, the computing system 76 may be a portion of the main control system 77 (e.g., the control system present in the driller's cabin).

Figure 4:
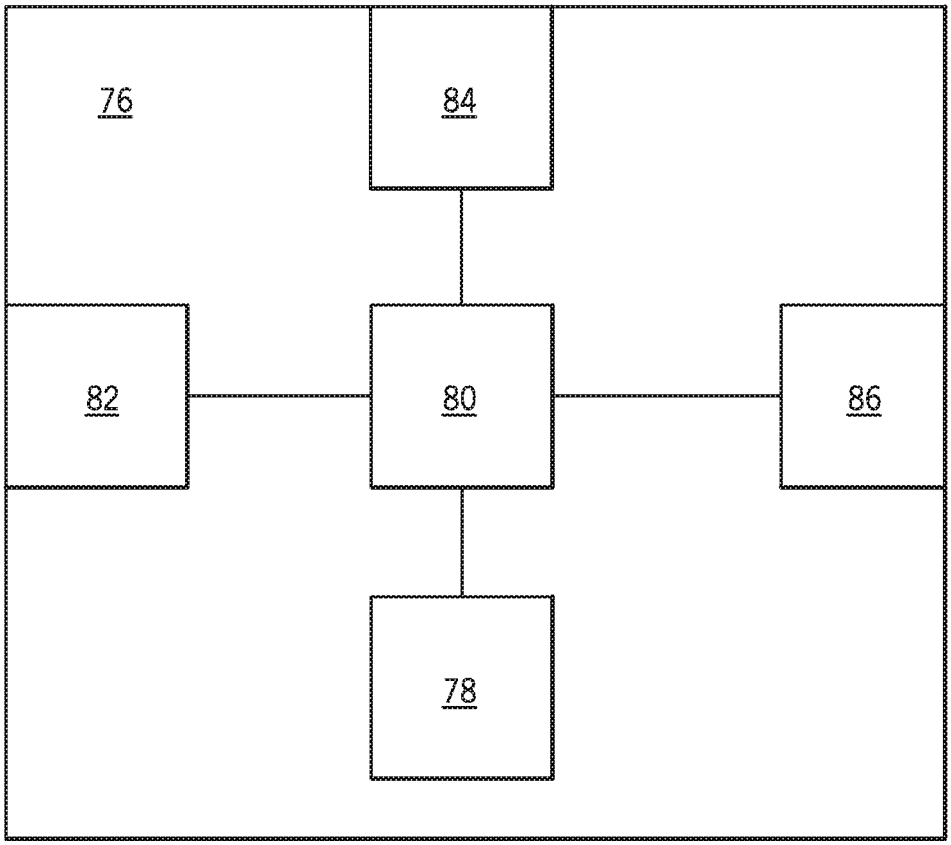
FIG. 4 a block diagram of a computing system of FIG. 2, in accordance with an embodiment.

An example of the computing system 76 is illustrated in FIG. 4. The computing system 76 may operate in conjunction with software systems implemented as computer executable instructions stored in a non-transitory machine readable medium of computing system 76, such as memory 78, a hard disk drive, or other short term and/or long term storage. Particularly, the techniques to described below with respect to tripping operations may be accomplished, for example, using code or instructions stored in a non-transitory machine readable medium of computing system 76 (such as memory 78) and may be executed, for example, by a processing device 80 or a controller of computing system 76 to control the previously described elements of FIGS. 2, 2A, and 3 during tripping operations.

Thus, the computing system 76 may be a general purpose or a special purpose computer that includes a processing device 80, such as one or more application specific integrated circuits (ASICs), one or more processors, or another processing device that interacts with one or more tangible, non-transitory, machine-readable media (e.g., memory 78) of the computing system 76 that collectively stores instructions executable by the processing device 80 to perform the methods and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processing device 80. In some embodiment, the instructions executable by the processing device 80 are used to generate, for example, control signals to be transmitted to, for example, one or more of the tripping apparatus 24 (e.g., the roughneck 54 and/or one or more of the fixed jaws 56, the makeup/breakout jaws 58, and the spinner 60), the tubular handling apparatus 42, the movable platform 28, the tubular segment support system, and/or ancillary elements related thereto for use in conjunction with a tripping operation.

The computing system 76 may also include one or more input structures 82 (e.g., one or more of a keypad, mouse, touchpad, touchscreen, one or more switches, buttons, or the like) to allow a user to interact with the computing system 76, for example, to start, control, or operate a graphical user interface (GUI) or applications running on the computing system 76 and/or to start, control, or operate, for example, one or more of the tripping apparatus 24 (e.g., the roughneck 54 and/or one or more of the fixed jaws 56, the makeup/ breakout jaws 58, and the spinner 60), the tubular handling apparatus 42, the movable platform 28, the tubular segment support system, and/or ancillary elements related thereto for use in conjunction with a tripping operation. Additionally, the computing system 76 may include a display 84 that may be a liquid crystal display (LCD) or another type of display that allows users to view images generated by the computing system 76. The display 84 may include a touch screen, which may allow users to interact with the GUI of the computing system 76. Likewise, the computing system 76 may additionally and/or alternatively transmit images to a display of the main control system 77, which itself may also include a non-transitory machine readable medium, such as memory 78, a processing device 80, one or more input structures 82, a display 84, and/or a network interface 86.

Returning to the computing system 76, as may be appreciated, the GUI may be a type of user interface that allows a user to interact with the computing system 76 and/or the computing system 76 and one or more sensors (e.g., the control system) through, for example, graphical icons, visual indicators, and the like. Additionally, the computing system 76 may include network interface 86 to allow the computing system 76 to interface with various other devices (e.g., electronic devices). The network interface 86 may include one or more of a Bluetooth interface, a local area network (LAN) or wireless local area network (WLAN) interface, an Ethernet or Ethernet based interface (e.g., a Modbus TCP, EtherCAT, and/or ProfiNET interface), a field bus communication interface (e.g., Profibus), a/or other industrial protocol interfaces that may be coupled to a wireless network, a wired network, or a combination thereof that may use, for example, a multi-drop and/or a star topology with each network spur being multi-dropped to a reduced number of nodes.

In some embodiments, one or more of the tripping apparatus 24 (and/or a controller or control system associated therewith), the tubular handling apparatus 42 (and/or a controller or control system associated therewith), the movable platform 28 (and/or a controller or control system associated therewith), the tubular segment support system (and/or a controller or control system associated therewith), and/or ancillary elements related thereto (and/or a controller or control system associated therewith) for use in conjunction with a tripping operation may each be a device that can be coupled to the network interface 86. In some embodiments, the network formed via the interconnection of one or more of the aforementioned devices should operate to provide sufficient bandwidth as well as low enough latency to exchange all required data within time periods consistent with any dynamic response requirements of all control sequences and closed-loop control functions of the network and/or associated devices therein. It may also be advantageous for the network to allow for sequence response times and closed-loop performances to be ascertained, the network components should allow for use in oilfield/drillship environments (e.g., should allow for rugged physical and electrical characteristics consistent with their respective environment of operation inclusive of but not limited to withstanding electrostatic discharge (ESD) events and other threats as well as meeting any electromagnetic compatibility (EMC) requirements for the respective environment in which the network components are disposed). The network utilized may also provide adequate data protection and/or data redundancy to ensure operation of the network is not compromised, for example, by data corruption (e.g., through the use of error detection and correction or error control techniques to obviate or reduce errors in transmitted network signals and/or data).

Figure 5:
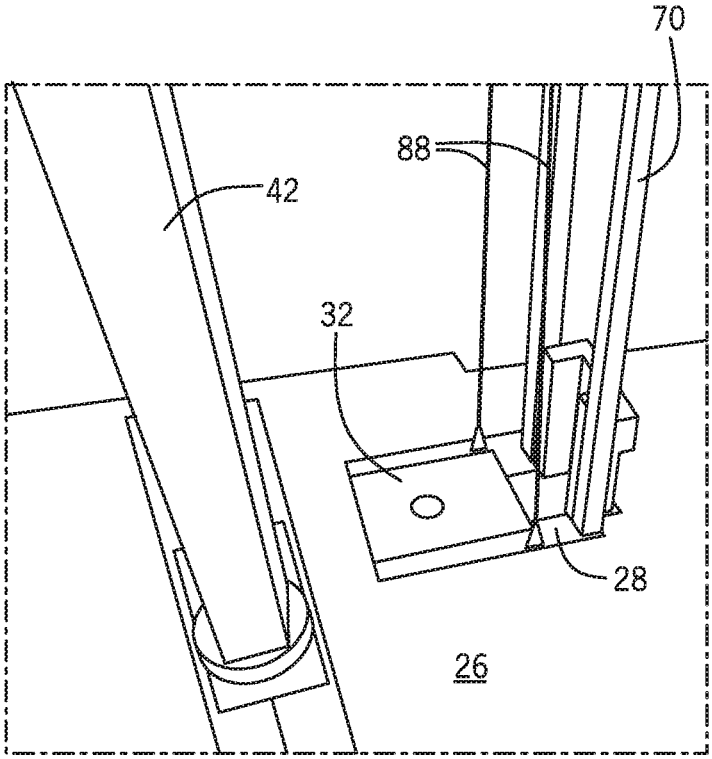
FIG. 5 illustrates a first view of the movable platform in the drill rig of FIG. 1, in accordance with an embodiment.

A tripping operation, for example, controllable by the computing system 76, will be discussed in greater detail with respect to FIGS. 5-17. Turning to FIG. 5, the movable platform 28 is illustrated in a locked position planar with the drill floor 26. As illustrated, two wires 88 (although more or fewer wires 88 may be used) are coupled to the movable platform 28 and may operate to move the movable platform 28 in conjunction with a cable and sheave arrangement (e.g., similar to the block and tackle system for movement of the top drive 38) that may include a winch or other drawworks element positioned on the drill floor 26 or elsewhere on the offshore platform 10 or the drilling rig 22, a suspended winch and cable system mechanism disposed such that the movable platform 28 is between the and the suspended winch and cable system and the drill floor 26. Likewise, internal or external actuation systems, such as hydraulic cylinders or the like may be used in addition to or in place of the aforementioned movement systems to move the movable platform 28 along support element 70.

Figure 7:
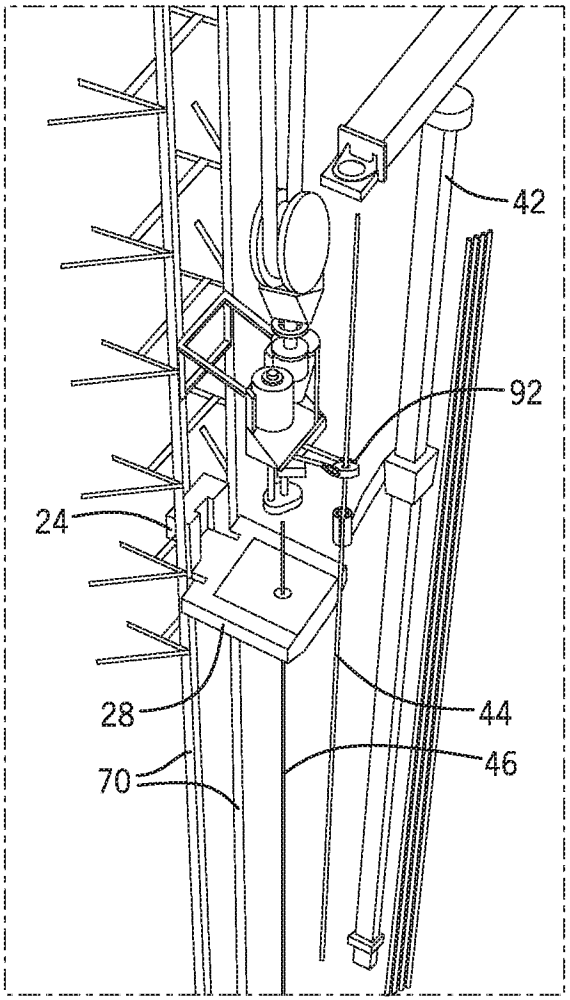
FIG. 7 illustrates a third view of the movable platform in the drill rig of FIG. 1, in accordance with an embodiment.
Figure 6:
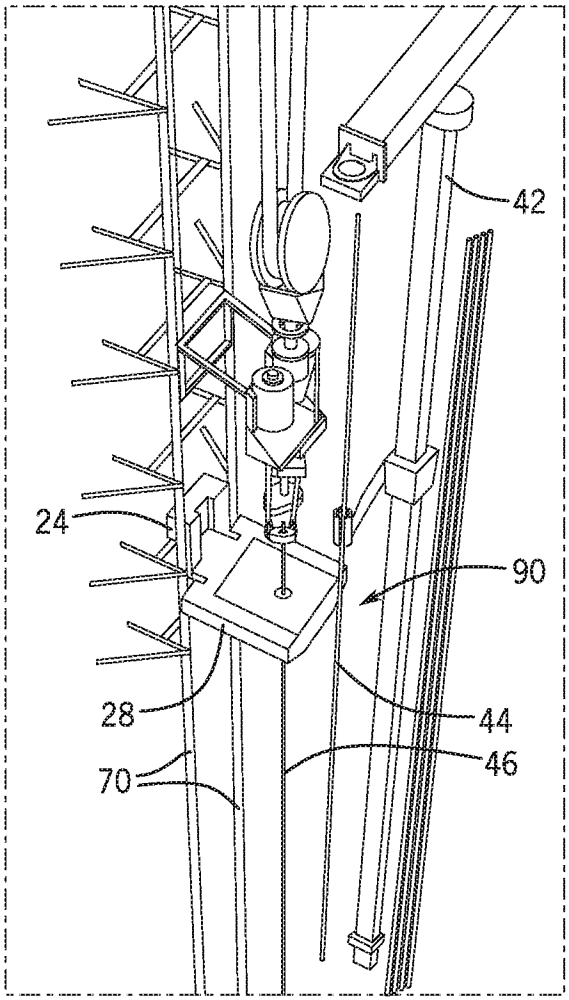
FIG. 6 illustrates a second view of the movable platform in the drill rig of FIG. 1, in accordance with an embodiment.
Figure 8:
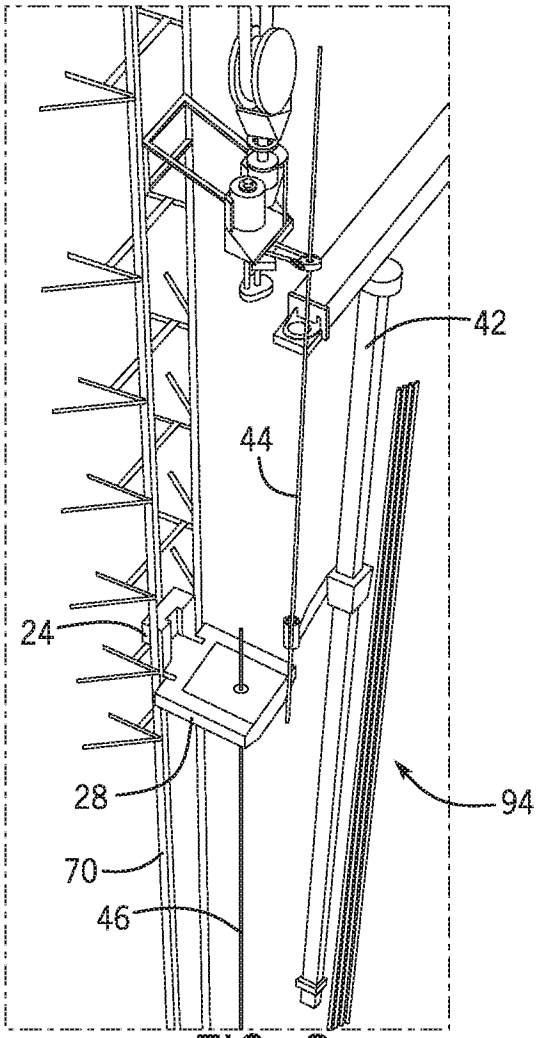
FIG. 8 illustrates a fourth view of the movable platform in the drill rig of FIG. 1, in accordance with an embodiment.

The movable platform 28 may be unlocked from the drill floor 26 and moved to initiate a tripping operation. To begin the tripping operation (in the illustrated example, a tripping-in operation), tubular handling apparatus 42 may position a tubular segment 46 to be supported by elevator 40. Elevator 40 supports tubular segment 46 and lowers it towards the wellbore. As elevator 40 lowers tubular segment 46, movable platform 28 may move to an upper position at height 90, as illustrated in FIG. 6. At this time, floor slips 30 may actuate and grasp tubular segment 46 while the elevator releases the tubular segment 46. Subsequently, as illustrated in FIG. 7, the movable platform 28 may begin to move towards the drill floor 26 while one or more elevator links or bales 92, which may be selectively actuated to connect to a tubular segment 44 (e.g., grasp tubular segment 44). The elevator 40 may continue to move away from the drill floor 26 while the movable platform moves towards the drill floor 26 until the movable platform 28 reaches a height 94 (closer to drill floor 26 than height 90), as illustrated in FIG. 8.

Figure 9:
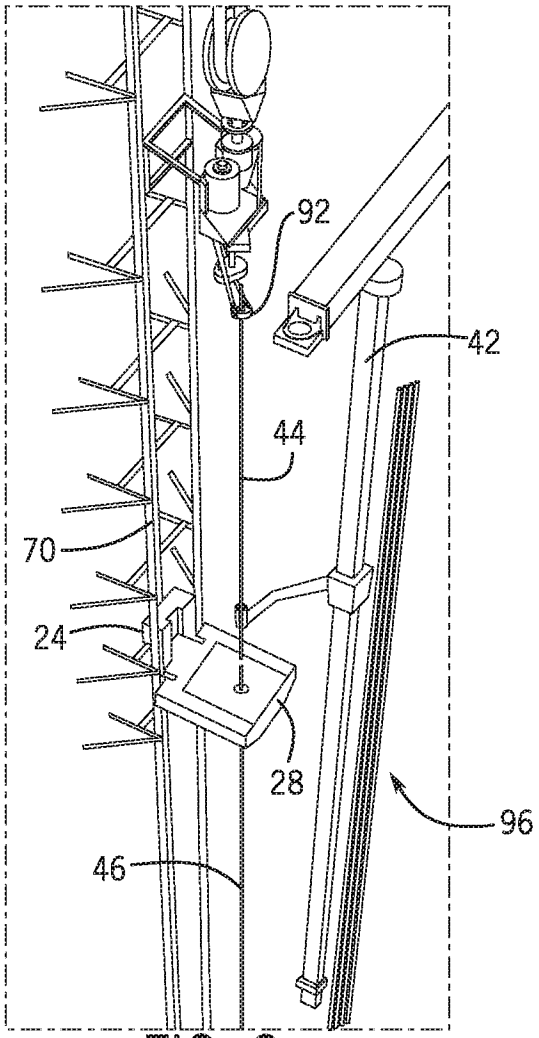
FIG. 9 illustrates a fifth view of the movable platform in the drill rig of FIG. 1, in accordance with an embodiment.
Figure 11:
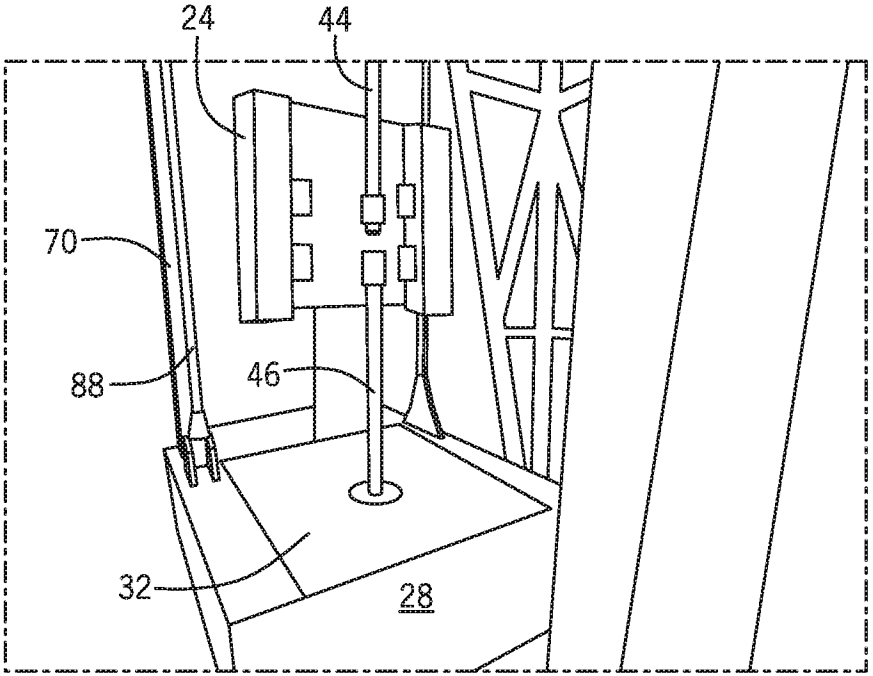
FIG. 11 illustrates a seventh view of the movable platform in the drill rig of FIG. 1, in accordance with an embodiment.
Figure 10:
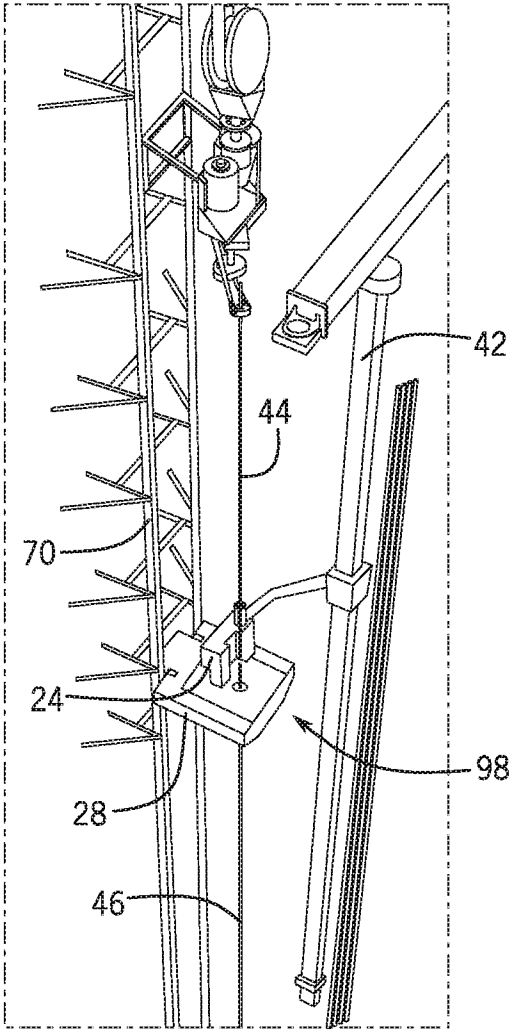
FIG. 10 illustrates a sixth view of the movable platform in the drill rig of FIG. 1, in accordance with an embodiment.

As the movable platform 28 reaches height 94, the one or more elevator links or bales 92 (separate from or in conjunction with the tubular handling apparatus 42) begin to move the tubular segment 44 to be in alignment (for example, vertical alignment) with tubular segment 46 as the movable platform 28 continues its movement towards the drill floor 26. As illustrated in FIG. 9, this process continues until the movable platform 28 reaches a height 96 (closer to drill floor 26 than height 94). When the movable platform 28 is at height 96, the tubular segment 44 is alignment with tubular segment 46. At this time, the tubular handling apparatus 42 (separate from or in conjunction with the elevator 40) moves the tubular segment 44 towards tubular segment 46, while movable platform 28 continues its movement towards the drill floor 26. As illustrated in FIG. 10, as the movable platform 28 reaches height 98 (closer to drill floor 26 than height 94), the tubular segment 44 has been brought in close proximity (e.g., within less than a foot, less than two feet, or another distance) from tubular segment 46 by the tubular handling apparatus 42 (separate from or in conjunction with the elevator 40). Also illustrated in FIG. 10 is movement of the tripping apparatus 24 from a first position adjacent to support element 70 to a second position adjacent to tubular segments 44 and 46 (e.g., via rails or other guides along the movable platform 28). A closer illustration of this positioning of the tripping apparatus 24 is illustrated in FIG. 11.

Figure 12:
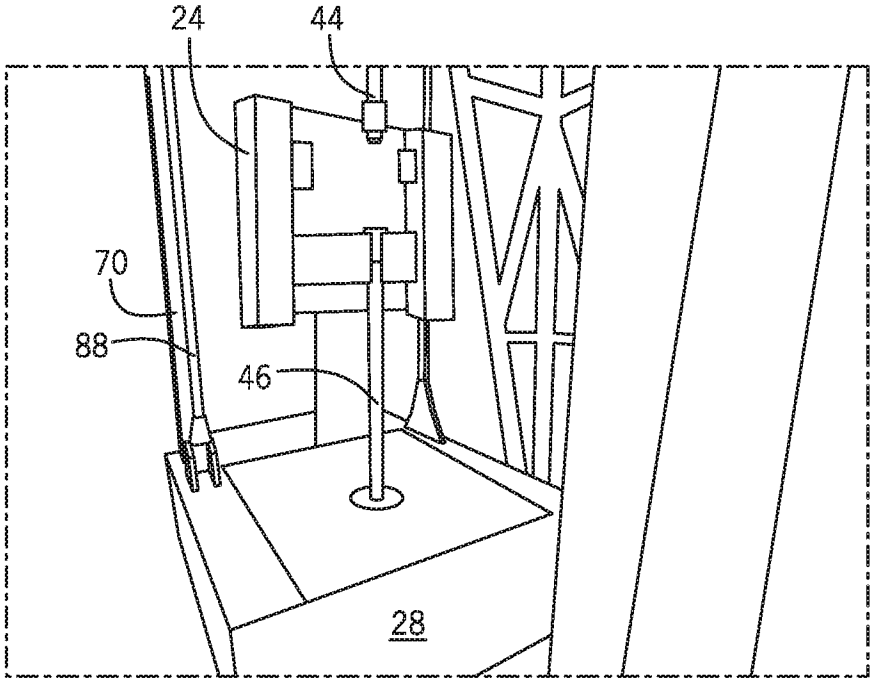
FIG. 12 illustrates eighth view of the movable platform in the drill rig of FIG. 1, in accordance with an embodiment.
Figure 14:
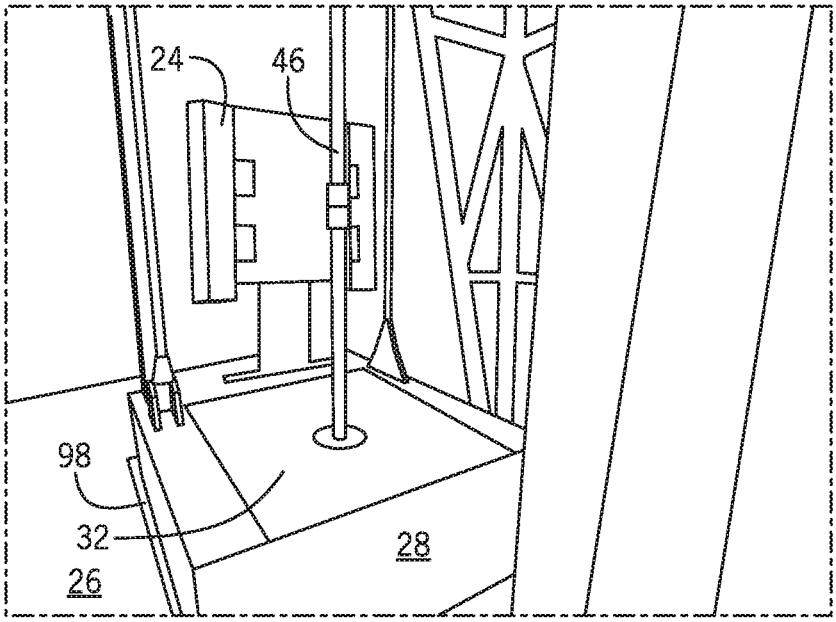
FIG. 14 illustrates tenth view of the movable platform in the drill rig of FIG. 1, in accordance with an embodiment.

Downward movement of the tubular segment 44 until it can be coupled to the tubular segment 46 is accomplished via the tubular handling apparatus 42 (separate from or in conjunction with the elevator 40), as illustrated in FIG. 12. At this time, the coupling of tubular segment 44 and 46 is performed by the tripping apparatus 24, as previously described in conjunction with FIG. 2A above. For example, during this coupling process, tripping slips 48 inclusive of slip jaws 50 engage and hold the tubular segment 46. At this time, the tubular segment 46 may be released from the tubular handling apparatus 42 and/or the elevator 40. Movement of the movable platform may continue towards the drill floor 26 during the coupling process described herein.

The roughneck 54 may operate to make-up a threaded connection between tubular segments 44 and 46 in a tubular string. As previously noted, the roughneck 54 may include one or more of fixed jaws 56, makeup/breakout jaws 58, and a spinner 60. The fixed jaws 56 may be positioned to engage and hold the (lower) tubular segment 46 below a threaded joint 62 thereof. In this manner, when the (upper) tubular segment 44 is positioned coaxially with the tubular segment 46 in the tripping apparatus 24 (as illustrated in FIG. 12), the tubular segment 46 may be held in a stationary position to allow for the connection of the tubular segment 44 and the tubular segment 46 (e.g., through connection of the threaded joint 62 of the tubular segment 46 and a threaded joint 64 of the tubular segment 44).

Figure 13:
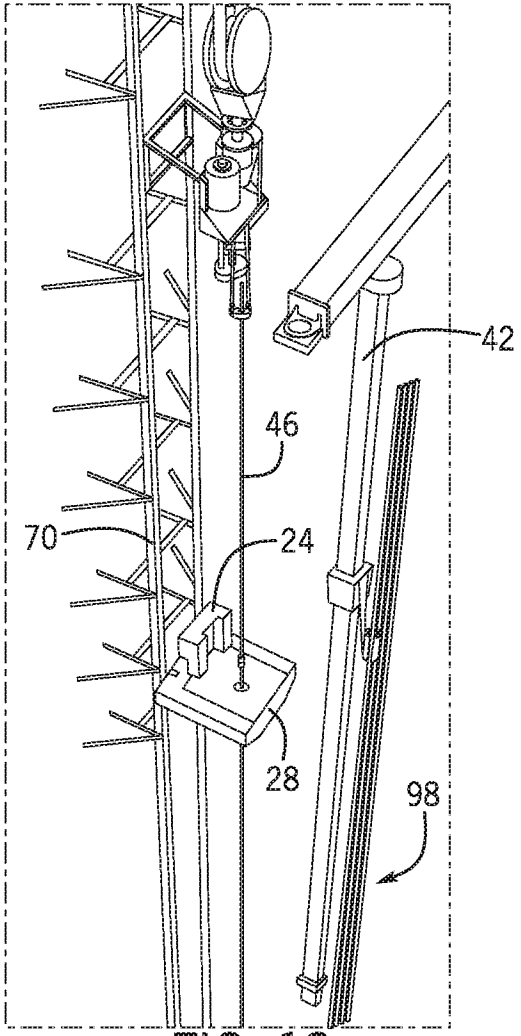
FIG. 13 illustrates ninth view of the movable platform in the drill rig of FIG. 1, in accordance with an embodiment.
Figure 15:
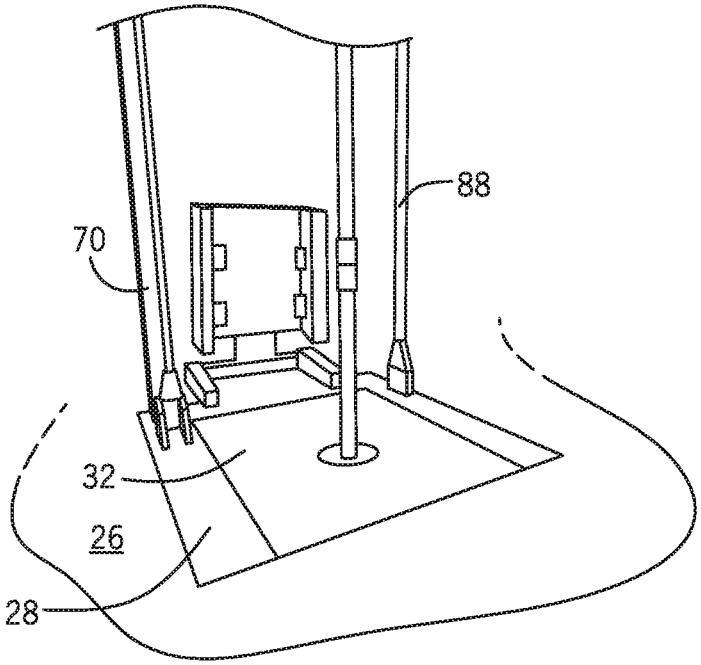
FIG. 15 illustrates eleventh view of the movable platform in the drill rig of FIG. 1, in accordance with an embodiment.

As the tripping apparatus 24 completes the make-up of tubular segments 44 and 46, the elevator 40 may reengage tubular segment 46 while the tripping apparatus 24 releases both tubular segments 44 and 46. During these actions, the tubular handling apparatus 42 may fetch another tubular segment from a pipe rack, as illustrated in FIG. 13. Moreover, the movable platform 28 may be at a height 98 and the elevator 40 may be moving in a direction towards the drill floor 26 similar to the movable platform 28. In some embodiments, this height 98 is closer to drill floor 26 than height 96 and is further represented in FIG. 14. As illustrated in FIG. 15, the movable platform 28 may continue moving until a height planar with the drill floor 26 is reached. At this time, the tripping apparatus 24, which may have begun moving from its second position adjacent to tubular segments 44 and 46 to its first position adjacent to support element 70 in FIG. 13, will have completed its movement into its first position adjacent to support element 70, as illustrated in FIG. 15. Additionally, the floor slips 30 may actuate and release tubular segment 44 while the elevator 40 continues to move towards the drill floor 26.

Figure 17:
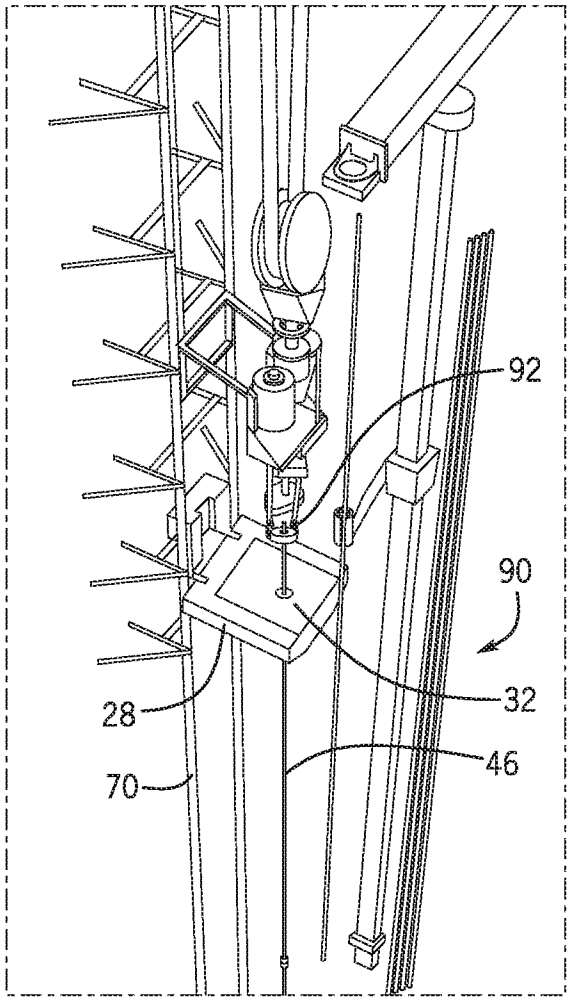
FIG. 17 illustrates thirteenth view of the movable platform in the drill rig of FIG. 1, in accordance with an embodiment.
Figure 16:
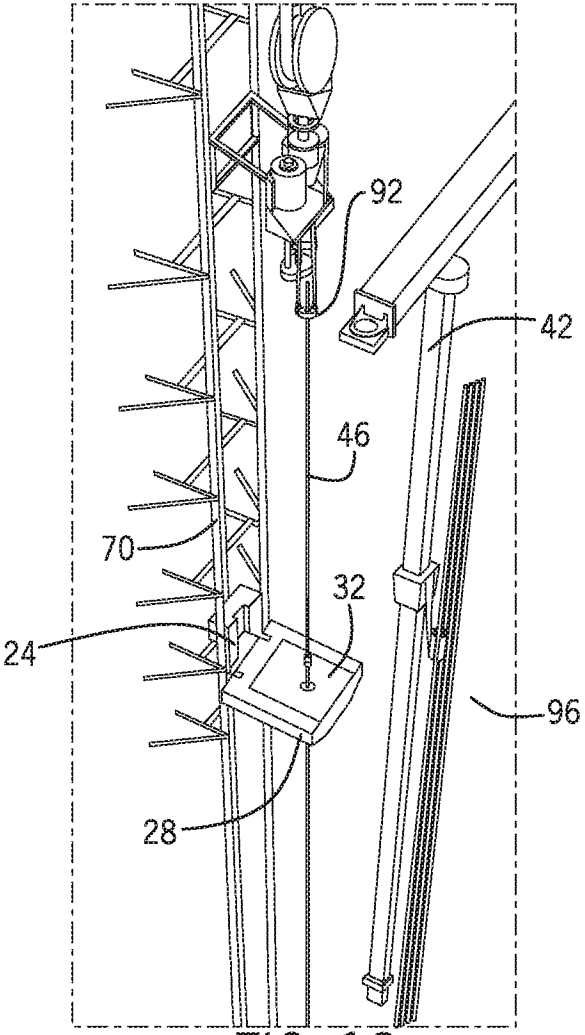
FIG. 16 illustrates twelfth view of the movable platform in the drill rig of FIG. 1, in accordance with an embodiment.

As illustrated in FIG. 16, the movable platform 28 may begin movement away from drill floor 26 back to approximately height 96 while the elevator 40 continues to move towards the drill floor 26. This may continue until, as illustrated in FIG. 17, the movable platform 28 reaches height 90, the floor slips 30 actuate, the elevator 40 releases tubular segment 46, and the tripping-in operation begins again with a new tubular segment to be coupled to tubular segment 46. Likewise, a tripping-out process can be completed through reversal of the steps described above. Namely, the movable platform 28 may reach height 90, release a tubular segment to elevator 40, move to the position in FIG. 15, activate floor slips 30, move to height 98 while the tripping apparatus 24 moves towards the tubular segments coupled above the movable platform (similar to FIG. 14), decouple the tubular segments and move back into a position adjacent to support element 70 (similar to FIG. 9) while the one or more elevator links or bales 92 move the decoupled tubular segment away from the movable platform 28 for the tubular handling apparatus 42 to store in the pipe rack. The movable platform 28 may continue to move away from the drill floor 26 until, similar to FIG. 6, the elevator can engage on the tubular segment held by the movable platform 28, the movable platform 28 may release the tubular segment (e.g., via floor slips 30), and the break-out process can begin again in a manner similar to that described above.

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A system, comprising:

one or more supports disposed on a drill floor;

a movable support slidingly coupled to the one or more supports, wherein the movable support when in operation is selectively moved towards the drill floor during a tripping-in operation and away from the drill floor during a tripping out operation as part of a continuous tripping operation; and a tripping apparatus coupled to the movable support and configured to make up or break out a threaded joint between a first tubular segment and a second tubular segment, wherein the tripping apparatus is configured to be selectively movable parallel to the moveable support from a first position disposed proximate to the one or more supports and a second position at a distance away from the one or more supports to make up the threaded joint when the tripping apparatus is disposed in the second position during the tripping-in operation or to break out the threaded joint when the tripping apparatus is disposed in the second position during the tripping-out operation.

2. The system of claim 1, wherein the movable support comprises an internal actuation system that when in operation moves the movable support towards the drill floor and away from the drill floor.

3. The system of claim 1, comprising an external actuation system that when in operation moves the movable support towards the drill floor and away from the drill floor.

4. The system of claim 1, comprising an actuation system that when in operation vertically moves the movable support towards the drill floor and away from the drill floor.

5. The system of claim 1, comprising an actuation system that when in operation moves the movable support towards the drill floor and away from the drill floor at an incline.

6. The system of claim 1, wherein the movable support comprises a locking element that when actuated affixes the movable support into a first position with respect to the drill floor.

7. The system of claim 1, wherein the movable support comprises a lateral support that directly couples the movable support to at least one of the one or more supports.

8. A method, comprising:

moving a movable support along one or more supports disposed on a drill floor towards the drill floor during a tripping-in operation as part of a continuous tripping operation;

aligning a second tubular segment with a first tubular segment while the movable support is moving towards the drill floor during the tripping-in operation;

moving a tripping apparatus coupled to the movable support parallel to the moveable support from a first position disposed proximate to the one or more supports towards a second position at a distance away from the one or more supports during the tripping-in operation; and making-up the first tubular segment and the second tubular segment when the tripping apparatus is disposed in the second position during the tripping-in operation to directly couple the first tubular segment and the second tubular segment while the movable support is moving towards the drill floor.

9. The method of claim 8, comprising moving the tripping apparatus to the first position subsequent to making-up the first tubular segment and the second tubular segment.

10. The method of claim 9, comprising moving the movable support along the one or more supports away from the drill floor subsequent to directly coupling the first tubular segment and the second tubular segment.

11. An apparatus, comprising:

a movable support configured to be coupled to a support disposed on a drill floor via a connector, wherein the moveable support is configured to allow for movement along the support towards the drill floor during a tripping-in operation and away from the drill floor during a tripping-out operation as part of a continuous tripping operation; and a tripping apparatus coupled to the movable support, wherein the tripping apparatus is configured to make up or break out a threaded joint between a first tubular segment and a second tubular segment, wherein the tripping apparatus is configured to be selectively movable parallel to the moveable support between a first position disposed proximate to the support and a second position at a distance away from the support, wherein the tripping apparatus, when disposed in the second position, is configured to make up the threaded joint during the tripping-in operation and break out the threaded joint during the tripping-out operation.

* * * * *